United States Patent [19]

Marks

[11] Patent Number: 4,695,082

[45] Date of Patent: Sep. 22, 1987

[54] REVERSIBLE MORTISE LOCK

[76] Inventor: George R. Marks, 19 The Hemlocks, Roslyn Estates, N.Y. 11576

[21] Appl. No.: 833,026

[22] Filed: Feb. 26, 1986

[51] Int. Cl.[4] ..... E05C 1/12; E05B 15/00

[52] U.S. Cl. ..... 292/169.16; 292/244; 292/245; 70/486

[58] Field of Search ..... 292/169.16, 244, 245, 292/153; 70/486

[56] References Cited

U.S. PATENT DOCUMENTS

| | | | |
|---|---|---|---|
| 1,796 | 9/1840 | Rodgers | 292/169.16 |
| 92,153 | 7/1869 | Brooks | 70/486 |
| 105,334 | 7/1870 | Hopkins | 292/245 |
| 246,145 | 8/1881 | Keil | 70/486 |
| 314,738 | 3/1885 | Sparks | 292/245 |
| 348,657 | 9/1886 | Briggs | 292/169.16 |
| 431,523 | 7/1890 | Lincoln | 292/245 |
| 461,780 | 10/1891 | Berry | 70/486 |
| 563,867 | 7/1896 | Moser | 70/486 |
| 1,841,388 | 1/1932 | Unger | 292/169.16 |
| 1,892,709 | 1/1933 | Shaw | 70/486 |
| 1,932,733 | 10/1933 | Hendrick | 70/486 |
| 2,086,982 | 7/1937 | McCarter | 70/486 |
| 3,361,464 | 1/1968 | Foster | 292/245 |
| 4,502,720 | 3/1985 | Fayerman et al. | 292/169.16 |

FOREIGN PATENT DOCUMENTS

| | | | |
|---|---|---|---|
| 521751 | 8/1953 | Belgium | 292/244 |
| 133454 | 10/1951 | Sweden | 292/169.16 |
| 16156 | 1/1907 | United Kingdom | 70/486 |

*Primary Examiner*—William F. Pate, III
*Assistant Examiner*—Michael Safavi
*Attorney, Agent, or Firm*—Alan H. Levine

[57] ABSTRACT

A reversible mortise lock including a housing having a front plate and side walls, and a latch movable between an extended position in which it projects through the front plate, and a retracted position. Two spindle hubs, for cooperation with the spindles of inner and outer door knobs, are independently pivotable about a fixed axis, the latch moving from its extended to retracted position in response to pivotal movement of either spindle hub. An abutment member is pivotable between two extreme positions; in one extreme position it interferes with pivotal movement of one spindle hub, but not the other, so as to prevent that one hub from causing retracting movement of the latch; in the other extreme position, the abutment member does not interfere with movement of either spindle hub. The abutment member is exposed through an opening in the front plate so that it can be swung between its extreme positions by finger pressure. A pivot pin, upon which the abutment member is pivotally mounted, is removable through a hole in one of the housing side walls to free the abutment member for removal through the opening in the front plate. Upon removal of the abutment member, it can be reversed and reinserted into the housing and its pivot pin replaced. The abutment member will then, in one of its extreme positions, interfere with pivotal movement of the other of the two spindle hubs but not with the one which it previously interfered with.

10 Claims, 10 Drawing Figures

REVERSIBLE MORTISE LOCK

This invention relates to mortise locks, and more particularly to such locks which can be reversed so that retraction of the latch by either of the two door knobs can be prevented.

A mortise lock is one designed to fit into a cavity provided in the vertical edge of a door opposite the edge which is hinged to the door frame. The lock includes a housing within which is usually a latch slidable between an extended position, in which it projects beyond the edge of the door into an opening in the door frame to latch the door closed, and a retracted position, in which it permits opening of the door. Inner and outer door knobs, mounted on spindles, cooperate with the mortise lock in such a way that rotation of the inner door knob causes retraction of the latch; at the option of the homeowner, the outer door knob can be rotated to retract the latch or the outer door knob can be locked against rotation so that it cannot be used to retract the latch to permit opening of the door.

The optional operation of the outer door knob is usually controlled by a finger-operable arrangement including two push buttons, or a pivoted rocker member, exposed at the edge of the mortise lock near the latch. When one of the push buttons is depressed, it slides an associated link within the mortise lock housing into engagement with a hub rotatable with the outer door knob spindle so as to prevent rotation of the hub and hence of the outer door knob. When the other push button is depressed, the link slides out of engagement with the hub permitting rotation of the outer door knob. The inner door knob is unaffected by the manipulation of the push buttons and remains rotatable at all times.

Any particular door may be hinged to the door frame along its left side edge or the right side edge of a door. A mortise lock mounted in the left edge of a door is rotated 180° about a vertical axis with respect to the same lock mounted in the right side edge of a door. Consequently, the inner and outer door knobs of the left side mounted lock are the outer and inner door knobs, respectively, of a right side mounted lock. In any given mortise lock assembly, if the door knob controlled by the push button arrangement happens to be the outer door knob when the lock is installed, no modification of the lock is required. However, if that door knob should be the inner knob, a change must be made.

This is typically accomplished by opening the mortise lock housing, i.e., removing one of the housing side walls to expose the interior. The two slidable links are removed and their positions reversed; the result is that the spindle hub previously unaffected by depression of the push buttons is now locked against rotation in response to depression of one of the push buttons while the other spindle hub is now unaffected by push button operation. In effect, the inner and outer door knobs have been operatively reversed. The lock housing is then reclosed, and the lock may be inserted into the cavity in the edge of a door.

The need to open the housing of a conventional mortise lock, in order to reverse the operation of the two knobs, presents a number of problems. The chore of opening the housing and interchanging the locations of the slidable links is time consuming and must be done with care. Further, the housing contains a number of components, including springs and small parts, which can inadvertently fall out of place and either become lost or present the problem of replacing them in the correct location in the housing.

It is a general object of the present invention to overcome these problems by providing a mortise lock in which the housing need not be opened in order to reverse the door knob operation, so that one knob rather than the other is optionally prevented from retracting the latch.

It is another object of the invention to provide such a lock wherein the finger-operable arrangement includes a rocker or abutment member (rather than push buttons) which acts directly on one or the other of the spindle hubs, rather than through slidable links.

It is a further object of the invention to provide such a lock wherein the rocker member, in one of its two stable positions, prevents rotation of one of the spindle hubs, the rocker member being removable from the lock housing and replaceable therein in a different orientation so as to be capable of preventing rotation of only the other spindle hub, all without opening the lock housing.

Additional objects and features of the invention will be apparent from the following description in which reference is made to the accompanying drawings.

Figure 1:
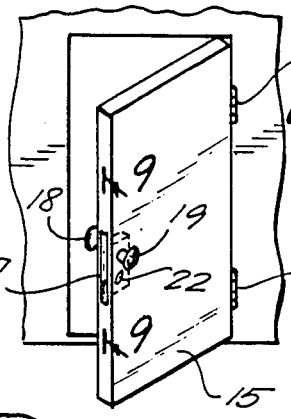
FIG. 1 is a perspective view of a "left hand" door hinged to the door frame along its right side, the door being equipped with a mortise lock according to this invention.
Figure 2:
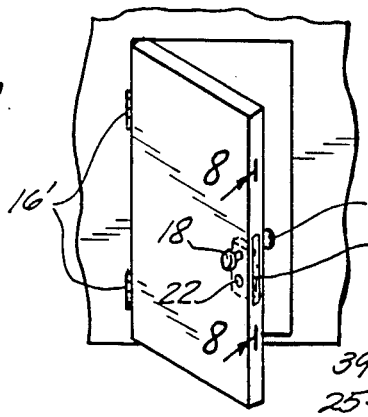
FIG. 2 is a view similar to FIG. 1 of a "right hand" door hinged to the frame along its left side.

In each of FIGS. 1 and 2, the door illustrated is being viewed from the inside. The door 15 of FIG. 1 involves a left hand mounting since it opens from the left and is hinged at 16 along its right side to the door frame. A mortise lock 17 is mounted within a cavity formed in the left side edge of door 15. The door carries an outside door knob 18 and an inside door knob 19, the door knobs being mounted on, and rotatable with, door knob spindles 20 and 21, respectively (see FIGS. 5 and 6) each having a square cross-sectional shape. A lock cylinder 22, operable from the outside side of the door by a key, is mounted below the door knobs.

The door 15' of FIG. 2 involves a right hand mounting since it opens from the right and is hinged at 16' along its left side to the door frame. If the same mortise lock 17 is installed in door 15', it will be seen that door knob 18, which was the outside door knob in FIG. 1, is the inside door knob in FIG. 2, and door knob 19, which was the inside door knob in FIG. 1, is the outside door knob in FIG. 2. Door knob 18 could serve as the outside door knob in FIG. 2 if lock 17 were rotated 180° about a horizontal axis before mounting in door 15'. However, if this were done, lock cylinder 22 would be above the door knobs, and the door may not have been prepared to accept the lock in this way, i.e., the existing cylinder holes in the door may be below the door knob spindle holes.

Mortise lock 17 (FIG. 3) has a housing within which the lock parts are enclosed. The housing includes a front plate 25, side walls 26 and 27 (see also FIG. 4), a top wall 28, and a bottom wall 29. In use, the housing is completely accommodated within a cavity 30 (see FIG. 8) in the door edge, except that front plate 25 is exposed flush with the door edge surface.

Front plate 25 is formed with a rectangular opening 33 through which a latch 34 is slidable so that the latch can move between an extended position (shown in FIGS. 3,8, and 9), in which it projects from the housing, and a retracted position, in which it is substantially completely withdrawn into the lock housing. Latch 34 has a stem 32 (FIGS. 5, 6, 8, and 9) slidable rectilinearly within a guide 31 fixed to the lock housing. A spring 41 constantly urges latch 34 outwardly to its extended position.

Another rectangular opening 35 in front plate 25 accommodates a finger-operable abutment member, in this example the abutment member being in the form of a pivoted rocker member 36 (FIGS. 3–10). Front plate 25 is also formed with a rectangular opening 37 through which a dead bolt 38, operated by lock cylinder 22, can slide between an extended and a retracted position. Front plate 25 also has holes 39 near its upper and lower ends for accommodating screws 40 (FIG. 4) by which the lock is secured to the door.

Figure 3:
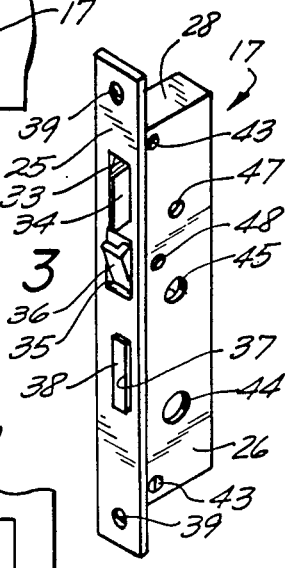
FIG. 3 is a perspective view of the mortise lock on an enlarged scale.
Figure 4:
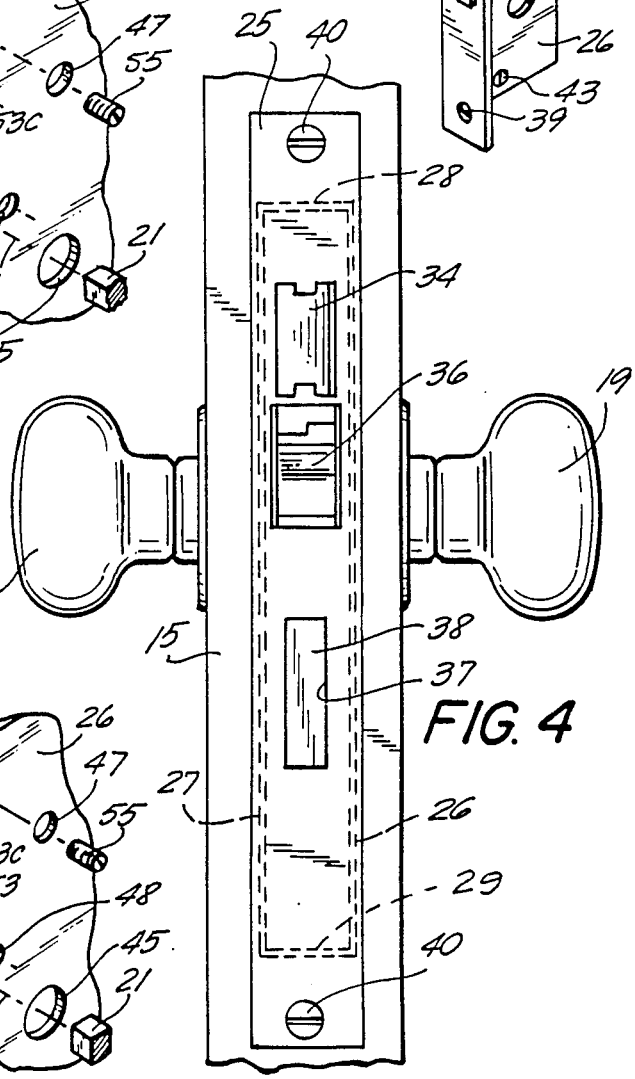
FIG. 4 is a fragmentary edge view of a door, on an enlarged scale, having a mortise lock installed in it.

. Side wall 26 is secured to the remainder of the lock housing by screws 43 (FIG. 3). After all the lock parts have been assembled, side wall 26 is secured in place and need not be removed except to repair the lock. A hole 44 in side wall 26 accommodates lock cylinder 22, a similar hole being provided in side wall 27. Another hole 45 (see also FIGS. 5 and 6) in each of walls 26 and 27 rotatably accommodates a door knob spindle 20 or 21. However, only side wall 26 is formed with two holes 47 and 48, the purpose of which will be described below.

Figure 5:
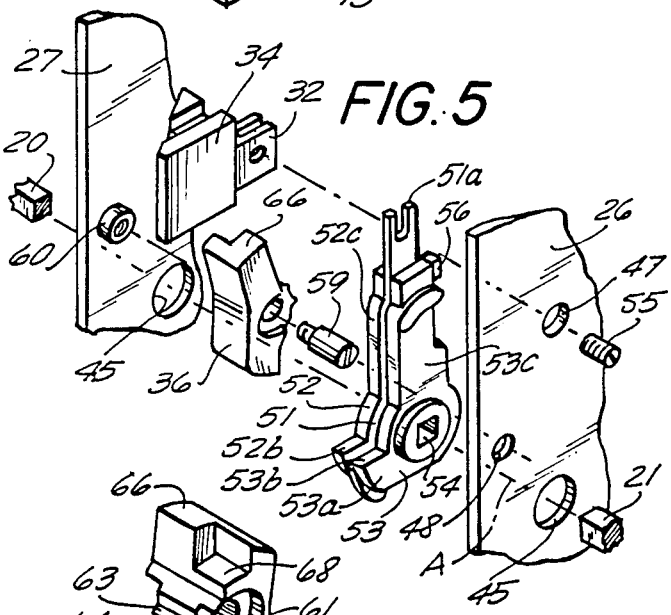
FIG. 5 is a fragmentary, exploded, perspective view of some of the lock parts, the rocker member being oriented to prevent rotation of one of the spindle hubs.
Figure 7:
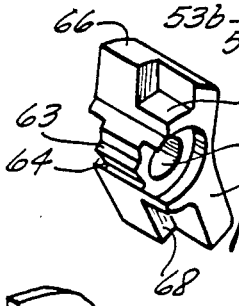
FIG. 7 is a perspective view, on an enlarged scale, of the rocker member.
Figure 6:
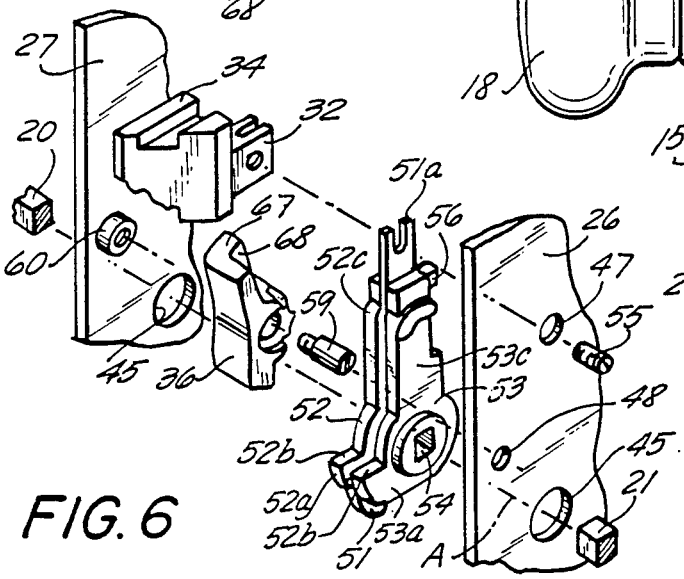
FIG. 6 is a view similar to FIG. 5, except that the rocker member is oriented, to prevent rotation of the other spindle hub.

Within the lock housing are a plate 51 sandwiched between two spindle hubs 52 and 53 (FIGS. 5 and 6). All three elements 51–53 are mounted for rotation about a single axis A, each being rotatable independently of the others. Holes 45, which accommodate spindles 20 and 21, are also located on axis A. Spindle hub 53 is formed with a square hole 54 adapted to snugly accommodate the inner end of spindle 21, and spindle hub 52 is formed with a similar square hole adapted to snugly accommodate the inner end of spindle 20. Thus, rotation of door knobs 18 and 19 is transmitted to hubs 52 and 53, respectively, by spindles 20 and 21, respectively.

Spindle hubs 52 and 53 are formed with laterally projecting fingers 52*a* and 53*a* which present faces 52*b* and 53*b*, respectively. In addition, the spindle hubs 52 and 53 having upwardly projecting arms 52*c* and 53*c*.

Plate 51 projects upwardly beyond the upper ends of arms 52*c* and 53*c*, and its upper end 51*a* is bifurcated. End 51*a* fits into a slot in latch stem 32, and a screw 55 (FIGS. 5,6,8, and 9) passes through threaded holes in the stem, on each side of the slot, as well as between the tines of the end 51*a* to produce a pivoted connection between the upper end of plate 51 and latch stem 32. Thus, rotation of plate 51 in a clockwise direction in FIGS. 5, 6, and 8 causes retraction of latch 34 into the lock housing against the force of spring 41. Hole 47 is aligned with screw 55, so that access to the slotted end of the screw is available through hole 47.

Just below its bifurcated end 51*a*, plate 51 carries two lugs 56 located alongside the upper ends of hub arms 52*c* and 53*c*. Consequently, when either spindle hub 52 or 53 is rotated clockwise, in FIGS. 4,5, and 8, the motion of the hub is transmitted to plate 51 by one of the lugs 56, thereby causing retracting movement of latch 34. A spring 57 (FIGS. 8 and 9) has one leg engaging the rear wall 58 of the housing and another leg pressing against plate 51 and spindle hubs 52 and 53 to constantly urge those elements in a counterclockwise direction as viewed in FIG. 8. Suitable stops (not shown) limit the counterclockwise movement of hubs 52 and 53 so that they cannot rotate past the position shown in FIG. 8.

Rocker member 36 is pivotally supported on a pin 59, the pin passing through a hole 61 (FIG. 7) in the rocker member and having a reduced diameter threaded end which screws into an internally threaded boss 60 (FIGS. 5 and 6) fixed to housing wall 27. Hole 48 in housing wall 26 is aligned with pin 59, so that access to the slotted end of the pin is available through hole 48.

Figure 8:
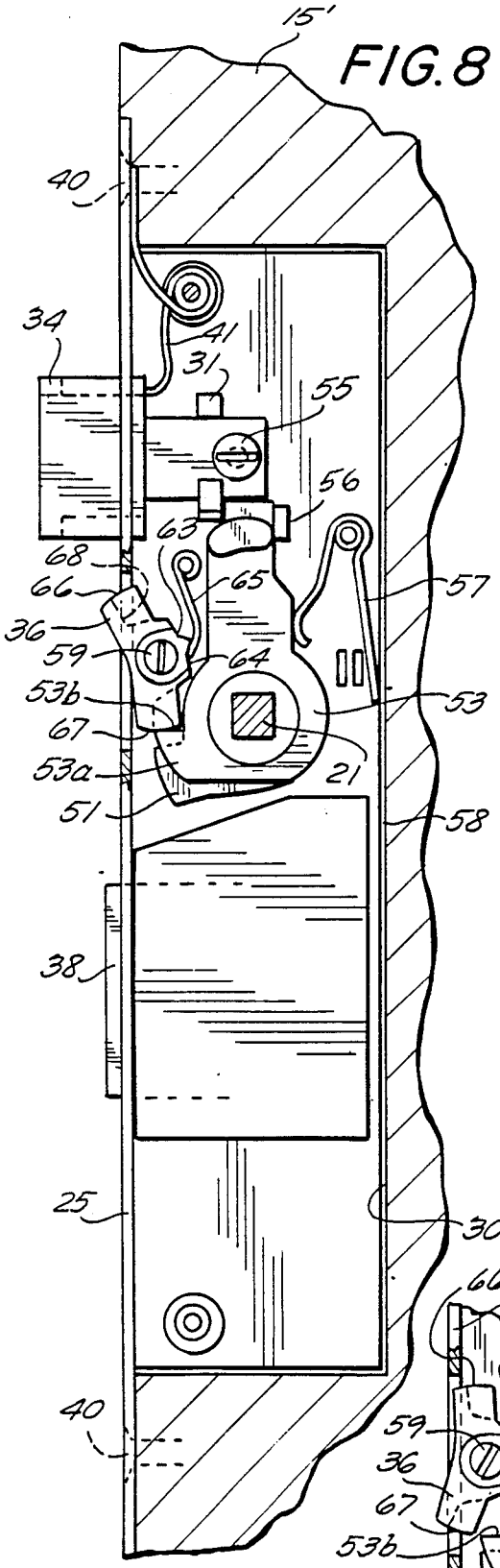
FIG. 8 is a fragmentary vertical cross-sectional view taken along line 8—8 of FIG. 2.
Figure 9:
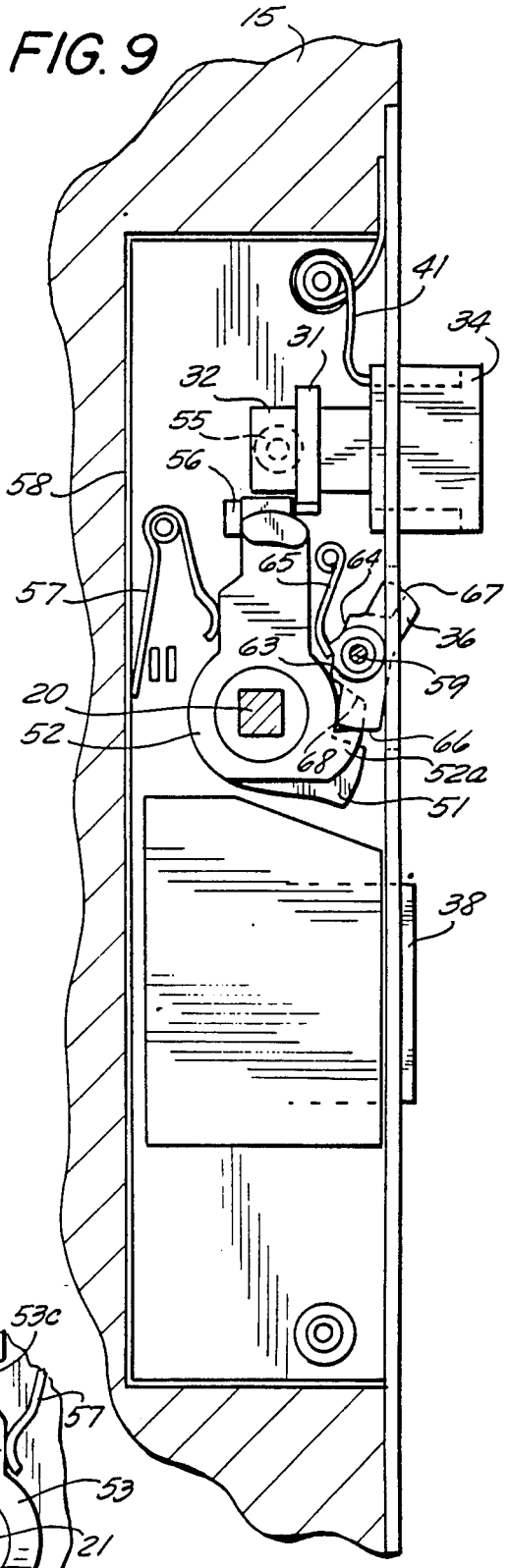
FIG. 9 is a fragmentary vertical cross-sectional view taken along line 9—9 of FIG. 1.
Figure 10:
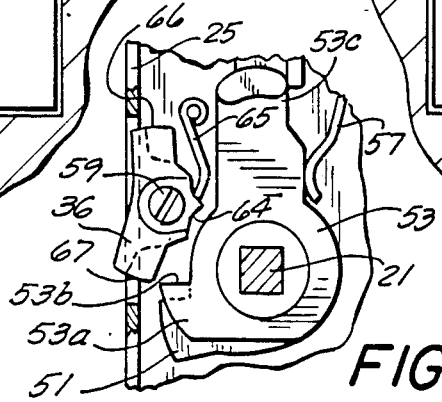
FIG. 10 is a view showing some of the parts illustrated in FIG. 8, the rocker member being in a position different from its position in FIG. 8.

Rocker member 36 can swing between two extreme stable conditions illustrated in FIGS. 8 and 10, respectively. The inner surface of member 36 is formed with a non-smooth shape to define two angularly spaced-apart seats 63 and 64 (FIGS. 7 and 8–10) which cooperate with the end of a leaf spring 65. When rocker member 36 is in the position shown in FIG. 8, spring 65 engages seat 64 to maintain member 36 in that position. If inwardly directed finger pressure is applied to the upper section of the rocker member, it swings about pin 59 until spring 65 snaps into seat 63, thereby maintaining rocker member 36 in the position of FIG. 10. Finger pressure against the lower section of the rocker member swings it back to the position of FIG. 8. At its two ends, rocker member 36 presents abutment surfaces 66 and 67, respectively. Each of the abutment surfaces is formed with a cut-out portion 68 (FIG. 7) which extends for about half the width of its respective abutment surface.

When rocker member 36 is in the orientation shown in FIGS. 5 and 8, and that member is in the position shown in FIG. 8, i.e., its lower section in and its upper section out, abutment surface 67 is directly opposed to, and preferably abuts, face 53*b* on finger 53*a* of spindle hub 53. At the same time, cut-out 68 of abutment surface 67 is directly opposed to face 52*b* on finger 52*a* of spindle hub 52. Hence, hub 53 cannot rotate, and therefore spindle 21 and outer door knob 19 (FIG. 2) cannot rotate. As a result, latch 34 cannot be retracted by means of outer door knob 19. However, rocker member 36 does not interfere with the rotation of hub 52, since upon such rotation finger 52*a* enters cut-out portion 68 of abutment surface 67. Consequently, inner door knob 18 (FIG. 2) is free to rotate spindle 20 and hub 52, this movement being transmitted to plate 51, via lug 56, and to latch 34, via screw 55, for retracting latch 34 into the lock housing and permitting the door to be opened.

If it is desired that latch 34 be retractable by means of outer door knob 19, the upper section of rocker member 36 is pushed inwardly to shift that member to its other extreme position, shown in FIG. 10. In this position, abutment surface 67 is out of the path of movement of finger 53*a*, so that spindle hub 53 is free to rotate. Now when door knob 19 is turned, spindle 21 and hub 53 turn with it, as does plate 51, resulting in latch 34 being retracted.

The description given above applies to installation of the mortise lock in the right hand door 15' of FIG. 2. If the same mortise lock is to be used in a left hand door 15( FIG. 1) instead, the orientation of rocker member 36 must be changed. To accomplish this, pin 59 is unscrewed and removed through hole 48 in side wall 26 of the lock housing. Once pin 59 is removed, rocker member 36 can be withdrawn from the housing through opening 35. The rocker member is then rotated 180° about a horizontal axis perpendicular to axis A, and reinserted into the housing through opening 35. Pin 59 is inserted through hole 48 and hole 61 in the rocker member and screwed into boss 60. The rocker member 36 will now be oriented as shown in FIGS. 6 and 9. When the rocker member is so oriented, and that member is in the position shown in FIG. 9, i.e., its lower section in and its upper section out, abutment surface 66 is directly opposed to, and preferably abuts, face 52*b* on finger 52*a* of spindle hub 52. At the same time, cut-out 68 of abutment surface 66 is directly opposed to face 53*b* finger 53*a* of spindle hub 53. Hence, hub 52 cannot rotate, and therefore spindle 20 and outer door knob 18 (FIG. 1) cannot rotate. As a result, latch 34 cannot be retracted by means of outer door knob 18. However, rocker member 36 does not interfere with rotation of hub 53, since upon such rotation finger 53*a* enters cut-out portion 68 of abutment surface 66. Consequently, inner door knob 19 (FIG. 1) is free to rotate spindle 21 and hub 53, this movement being transmitted to plate 51, via lug 56, and to latch 34, via screw 55, for retracting latch 34 into the lock housing and permitting the door to be opened. Outer door knob 18 can be freed to operate latch 34 by pressing the upper section of rocker member 36 inwardly, as described above with reference to FIG. 10.

It will be appreciated that removal, reversal, and reinsertion of rocker member 36 with respect to the lock housing was accomplished without opening the housing, and specifically without removing side wall 26 from the remainder of the housing.

When rocker member 36 is reversed, as described above, latch 34 must also be reversed. This is accomplished by removing screw 55 through hole 47 in side wall 26, withdrawing latch 34 from opening 33, rotating the latch 180° about a horizontal axis perpendicular to axis A, and replacing the latch and screw 55. This operation is also performed without opening the lock housing.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A reversible mortise lock comprising:

a housing having two opposed side walls and a front plate formed with a first opening, a latch movable with respect to the housing between an extended position, in which the latch projects from the housing through the first opening in the front plate, and a retracted position, in which the latch is substantially completely withdrawn into the housing, two spindle hubs within the housing independently pivotable about a fixed axis, the latch moving from said extended to said retracted position in response to pivotal movement of either spindle hub in a particular direction, a one-piece abutment member pivotable in a first orientation between two extreme positions, the abutment member being formed so that in one extreme position the abutment member directly interferes with pivotal movement of one of the spindle hubs, but not the other, so as to prevent said one hub from causing movement of the latch to its retracted position while permitting pivotal movement of the other spindle hub, and in the other extreme position the abutment member permitting pivotal movement of both spindle hubs, a second opening in the housing from plate through which the abutment member is exposed so that the abutment member can be swung from one extreme position to the other by finger operation, the second opening being large enough to permit the entire abutment member to pass through it, a pin mounted in the housing upon which the abutment member is supported for pivotal movement, and an opening in one of the housing side walls through which the pin can be removed to free the abutment member so that the latter can be removed from the housing through the second opening in the front plate without opening the housing, whereby the abutment member can be reversed with respect to said first orientation by rotating the abutment member 180° about a horizontal axis, and reinserted into the housing through the second opening, following which the pin can be reinserted in the housing to again pivotally support the abutment member, the abutment member said reversed orientation being capable of directly interfering with pivotal movement of the other of the two spindle hubs but not with said one of the hubs.

2. A reversible mortise lock as defined in claim 1 wherein each spindle hub includes a finger projecting from, and movable with, the hub, and the abutment member has an abutment surface located in a path of movement of one of the fingers but not the other when the abutment member is located in said one of said extreme positions.

3. A reversible mortise lock as defined in claim 2 wherein the abutment surface of the abutment member has a cut-out portion located to accommodate the other of the fingers when the respective spindle hub of said other finger is pivoted, so that the abutment member does not interfere with pivotal movement of said other finger and said respective hub.

4. A reversible mortise lock as defined in claim 2 wherein the abutment member has two abutment surfaces, one of those surfaces being located in the path of movement of one of the hub fingers when the abutment member is in said first orientation, and the other of the surfaces being located in the path of movement of the other of the hub fingers when the abutment member is in said reversed orientation.

5. A reversible mortise lock as defined in claim 1 wherein the abutment member is formed with two angularly spaced apart seats, and including a resilient member within the housing for engaging one or the other of the seats to maintain the abutment member in one or the other of said extreme positions.

6. A reversible mortise lock as defined in claim 1 including cooperable means carried by the pin and a second side wall of the housing opposite said one side wall having the opening for separably mounting the pin on said second side wall.

7. A reversible mortise lock as defined in claim 6 wherein the cooperable means are cooperable screw threads carried by the pin and said opposite side wall.

8. A reversible mortise lock as defined in claim 1 including resilient means for continuously urging both spindle hubs in a direction opposite to said particular direction.

9. A reversible mortise lock as defined in claim 1 wherein neither spindle hub is directly connected to the latch, and including means movable with each spindle hub for transmitting the motion of the hub to the latch.

10. A reversible mortise lock as defined in claim 9 wherein the transmitting means includes a plate pivotable on an axis coaxial with the pivot axis of the spindle hubs, the plate being free to rotate with respect to each spindle hub, and cooperable means carried by each spindle hub and the plate for causing the plate to pivot in said particular direction when either of the spindle hubs pivots in that direction.

* * * * *